US006826879B1

(12) United States Patent
Allen et al.

(10) Patent No.: US 6,826,879 B1
(45) Date of Patent: Dec. 7, 2004

(54) MODULAR BUILDING CONSTRUCTION

(75) Inventors: Bradford W. Allen, Westwood, MA (US); Stuart Lubin, Brookline, MA (US); Steve MacKenzie, Williston, VT (US)

(73) Assignee: Cathartes Investment, Boston, MA (US)

( * ) Notice: Subject to any disclaimer, the term of this patent is extended or adjusted under 35 U.S.C. 154(b) by 667 days.

(21) Appl. No.: 09/252,635

(22) Filed: Feb. 19, 1999

(51) Int. Cl.[7] ..... E04H 9/06
(52) U.S. Cl. ..... 52/236.3; 52/79.1; 52/143
(58) Field of Search ..... 52/79.1, 236.3, 52/143

(56) References Cited

U.S. PATENT DOCUMENTS

| | | | | | |
|---|---|---|---|---|---|
| 3,800,493 | A | * | 4/1974 | Livingston | 52/79 |
| 3,830,025 | A | | 8/1974 | Wainshal | 52/79 |
| 3,866,672 | A | | 2/1975 | Rich, Jr. et al. | 165/50 |
| 3,881,283 | A | | 5/1975 | Pender | 52/79 |
| 3,902,287 | A | | 9/1975 | Livingston | 52/73 |
| 3,952,474 | A | | 4/1976 | Rice | 52/747 |
| 3,982,732 | A | | 9/1976 | Pender | 254/139.1 |
| 4,050,215 | A | | 9/1977 | Fisher | 52/79.3 |
| 4,073,102 | A | | 2/1978 | Fisher | 52/79.13 |
| 4,118,905 | A | * | 10/1978 | Shelley | 52/79.2 |
| 4,136,492 | A | * | 1/1979 | Willingham | 52/79.7 |
| 4,138,833 | A | | 2/1979 | Townend | 52/745 |
| 4,194,339 | A | | 3/1980 | Fisher | 52/745 |
| 4,513,545 | A | * | 4/1985 | Hopkins, Jr. | 52/79.1 |
| 4,910,932 | A | | 3/1990 | Honigman | 52/280 |

* cited by examiner

*Primary Examiner*—Carl D. Friedman
*Assistant Examiner*—Basil Katcheves
(74) *Attorney, Agent, or Firm*—Choate, Hall & Stewart; Elizabeth E. Nugent

(57) ABSTRACT

A modular system of construction of loft apartment buildings. This type of unit is in high demand in many metropolitan areas, and the modular nature of the inventive buildings allows them to be produced quickly and at low cost. In addition, the invention provides a novel system for interconnecting apartments quickly during construction, providing further cost savings. A mix of apartment types, including handicapped-accessible apartments, may be placed in each building, with the proportions of different apartment types being tailored to the needs of the local market and the constraints of local building codes. The apartment modules may be sized to permit convenient shipping of modules within the constraints of overland shipping regulations.

27 Claims, 9 Drawing Sheets

MODULAR BUILDING CONSTRUCTION

FIELD OF THE INVENTION

The present application relates to modular systems and methods for assembling multiunit buildings, and particularly to systems and methods wherein individual units are constructed from multiple vertically stacked modules.

BACKGROUND OF THE INVENTION

Increasing demand for affordable housing in major metropolitan areas has necessitated the development of creative systems for housing design. One such solution is the renovation of underutilized or functionally obsolete buildings, often former industrial sites, into housing units. One advantage of such units has been the ability to produce "loft" apartments, in which at least a portion of each unit has double-height ceilings. These apartments have become popular in many markets, to the point that demand for such units may exceed the available supply of buildings to retrofit. The present invention provides a solution to this shortage, by providing an affordable system for building such units from the ground up.

In addition to the limited supply of buildings suited to be converted to loft apartments, another major impediment to the construction of multiunit housing has been the need to provide adequate parking space for each unit. The present invention also provides a solution which allows inexpensive modular construction of living units over an associated parking area, so that a larger number of apartments may be placed in a given lot while conforming to local zoning codes and providing adequate parking facilities.

SUMMARY OF THE INVENTION

The present invention provides a modular system of construction of loft apartment buildings. This type of unit is in high demand in many metropolitan areas, and the modular nature of the inventive buildings allows them to be produced quickly and at low cost. In addition, the invention provides a novel system for interconnecting apartments quickly during construction, providing further cost savings. A mix of apartment types, including handicap-accessible apartments, may be placed in each building, with the proportions of different apartment types being tailored to the needs of the local market and the constraints of local building codes. The apartment modules may be sized to permit convenient shipping of modules within the constraints of overland shipping regulations.

In one aspect, the invention comprises a multiunit building having a modular structure, in which each unit of the building is formed from a pair of vertically stacked modules. At least one room of the unit (hereinafter referred to as a "great room") extends from the floor of the lower module to the ceiling of the upper module (i.e., the unit is a loft apartment).

In one aspect, the invention comprises a multiunit building of modular construction, wherein multiple units of the building are each formed from two prefabricated modules, a lower module comprising a floor and four wall sections, and an upper module comprising a ceiling and four wall sections. At least one room of the unit extends the full height of the unit, i.e., from the floor of the lower module to the ceiling of the upper module. The unit may have a mezzanine level, in which at least one room is substantially contained within the upper module. The units may be arranged horizontally, vertically, or both. The building may also comprise lobby units, which may be vertically stacked and connected by a staircase and/or an elevator. The modules may be sized to comply with overland shipping regulations for transportation on a flatbed truck.

In another aspect, the invention comprises a method of building construction, comprising installing a foundation, placing a lower building module above the foundation, placing an upper building module on the lower module and securing the modules together. The modules combine to form a building unit, in which at least one room spans the distance from the floor of the first module to the ceiling of the second module. Multiple units may be placed vertically, horizontally, or both. Horizontally adjacent units may be connected by a utility feed. The modules may be constructed remotely and transported to the building site.

In still another aspect, the invention comprises a multiunit modular building, wherein horizontally adjacent units are connected via a corridor and a horizontal utility chase containing a utility feed. The utility feed may include water pipes, electrical wiring, communications and security systems, and life safety systems. The building may further comprise a lobby unit connected to the building units. Both building units and lobby units may be vertically stacked, and stacked lobby units may be connected via a vertical utility chase.

In yet another aspect, the invention comprises a method of constructing a modular building comprising installing two units, each containing a corridor section and a horizontal utility chase section containing a utility feed, and connecting the units and the utility feeds. The utility feeds may include water pipes, electrical wiring, communications and security systems, and life safety systems. The units may each comprise two vertically stacked modules as described above. The building may further contain one or more lobby units which may be connected to the utility feeds, and which may be stacked. Stacked lobbly units may be connected via a vertical utility chase.

BRIEF DESCRIPTION OF THE DRAWING

The invention is described with reference to the several figures of the drawing, in which.

DETAILED DESCRIPTION

The invention is described below with reference to certain preferred embodiments, in which an assembled apartment building comprises three types of living units, placed upon a conventional (nonmodular) semi-depressed parking level. It will be understood by those skilled in the art that this represents only one embodiment of the invention, and the invention encompasses many modifications and variations of the structures described herein. For example, the number, size, and shape of the living units may be varied over a wide range. The apartment units need not all be loft units; in fact, it may be desirable to include some single-level units in order to comply with handicap-access regulations. The outer walls of each unit need not be coplanar as shown below;

the invention also contemplates staggered or offset arrangements of units. Further, the principles of the invention may be applied to the construction of multi-unit office or industrial buildings, as well as living units. Commercial and dwelling units may even be mixed in a single building, within the constraints of local building codes.

Figure 1:
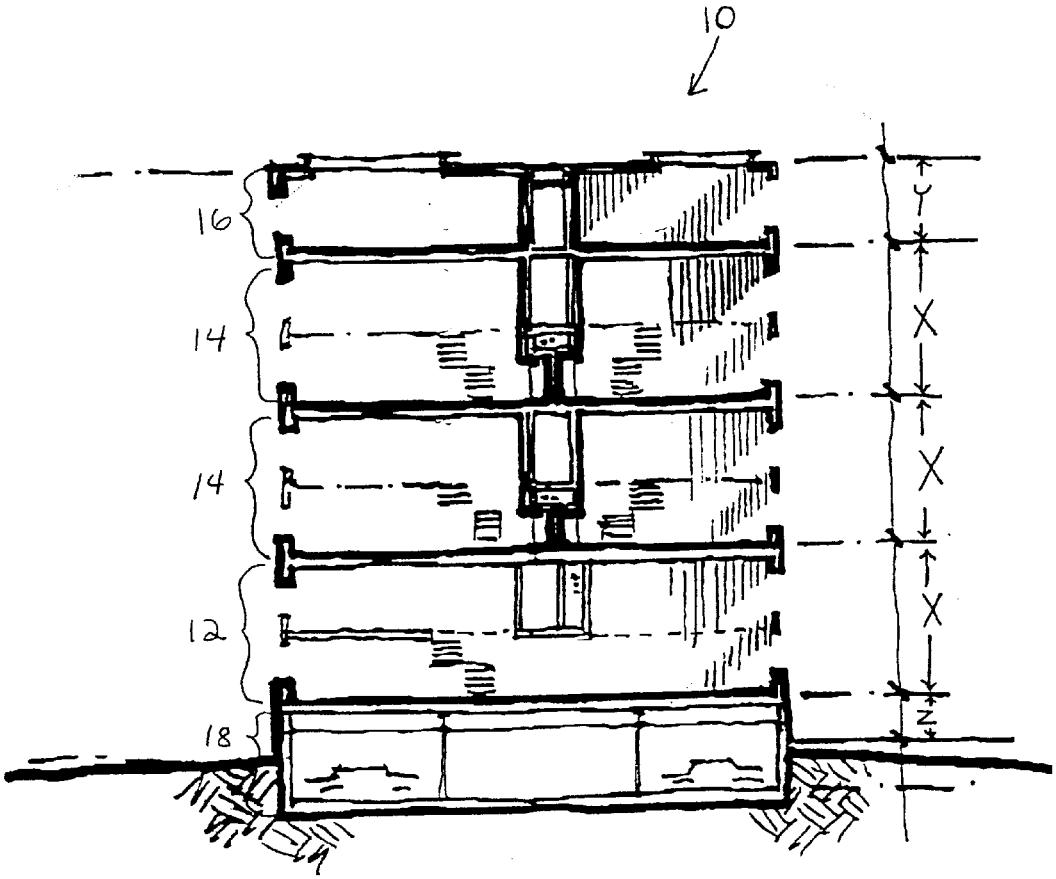
FIG. 1 is a cutaway view of an assembled apartment building comprising four apartment types according to the invention.

An apartment building according to the invention is illustrated in cutaway view in FIG. 1, generally as 10. The building 10 comprises three types of living units: base units 12, two stories of intermediate units 14, and top units 16. The illustrated building 10 also comprises a semidepressed parking level 18. The size and shape of units 12, 14, and 16 may be more clearly seen in FIGS. 7*a*-7*f*.

Figure 2:
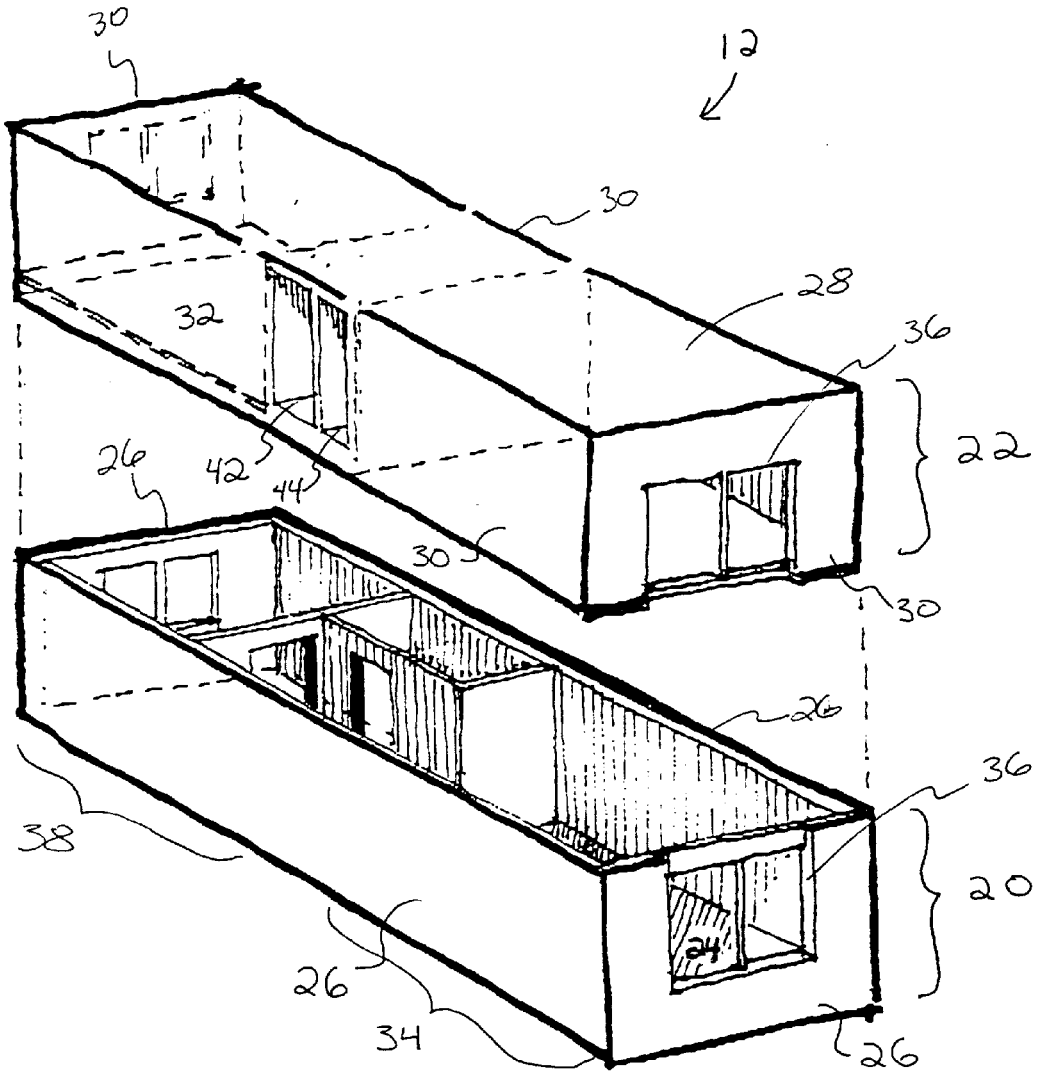
FIG. 2 is an exploded view of a "base" apartment of the building of FIG. 1, showing how two modules are stacked to form the apartment.
Figure 3:
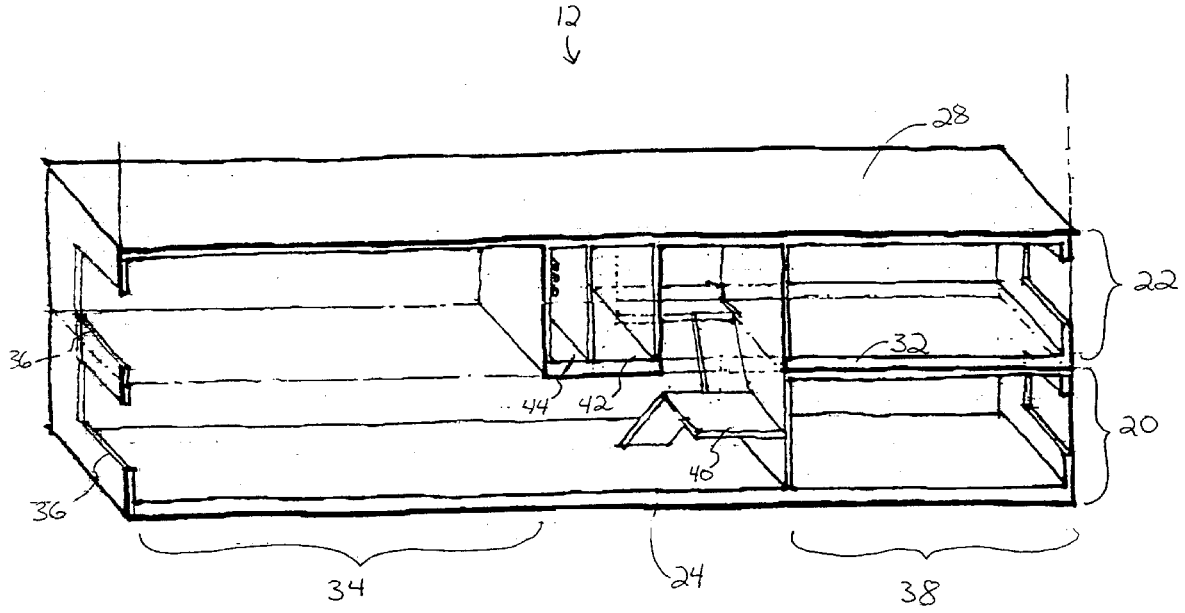
FIG. 3 is a cutaway view of the apartment unit of FIG. 2.

An exploded view of a base unit 12 is shown in FIG. 2. The unit comprises a lower module 20 and an upper module 22. Lower module 20 comprises a floor 24 and four vertical outer walls 26. Upper module 22 comprises a ceiling 28, four vertical outer walls 30, and a floor section 32. Floor section 32 spans only a portion of the module. Thus, when the modules are stacked to form the apartment unit, the unit comprises a great room 34 which has a floor-to-ceiling height spanning the two modules. Large windows 36 are preferably provided for the great room 34 to further increase the spacious feeling of the room afforded by the high ceiling. The rear section 38 of the apartment comprises floor-level rooms having section 24 as their floor, and mezzanine rooms having section 32 as their floor. Internal stairs 40 (more clearly seen in FIG. 3, a cutaway view of the same unit) allow access to the mezzanine level from the floor level.

It is preferable that modules 20 and 22 conform to overland shipping regulations for easy transportation. For example, a module may have a width not exceeding 14 feet, a length not exceeding 66 feet, and a height not exceeding 11 feet. These sizes are exemplary, and may be adjusted depending on the method of shipping used and on local shipping regulations. For example, greater size flexibility may be afforded when it is practical to ship the units by barge, ship, or helicopter, or when the modules are constructed at a location near the building site.

Figure 4:
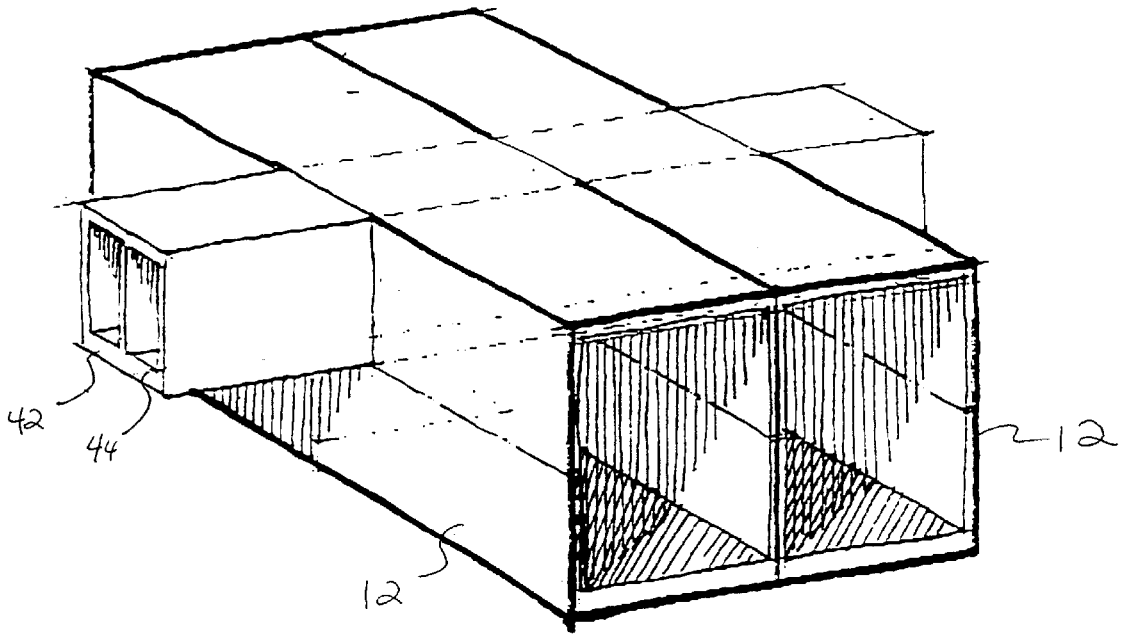
FIG. 4 is a perspective view of two units as shown in FIG. 2, illustrating corridor access and utility chase connections.

Access to the unit 12 is afforded by a corridor 42 which opens onto the mezzanine level. It will be seen that when multiple units 12 are placed side-by-side to form a building level, the corridors 42 will connect to form a joint accessway to the individual apartment units. A pair of units with connected corridor sections 42 can be seen in FIG. 4.

Shown adjacent to the corridor 42 is a horizontal chase 44 whereby building services such as water pipes, electrical wiring, communications and security systems, and sprinkler and other life safety systems (not shown) may be provided. It is an advantage of this type of building module that access to water pipes and the like may be provided by an access panel (not shown) on the common corridor 42, removing the necessity for workmen to enter individual apartments when performing maintenance.

It is a further advantage of the horizontal chase 44 that it facilitates easy connection of building services such as water and electricity. Pipes and wiring may be preinstalled in the chase when the unit is constructed, so that they need only be "plugged in" to an adjacent unit 12 when the building is assembled on-site. The prior art almost exclusively uses vertical chases for these services, so that pipes and wires must be fed through the chase by hand after the building is assembled.

The ease of connection of the building services also facilitates on-site "finishing" of the apartment unit. In this concept of building construction, module 22 is stacked atop module 20, and chase utility feed connections to the previously installed adjacent unit are immediately made. The newly installed unit 12 is then immediately powered, and workmen can simply turn on the preinstalled lights and plug power tools into existing wall outlets in order to finish securing the modules together and to the adjacent unit, and to install cosmetic elements such as molding to cover the module joints. In addition, construction site security can be maintained by immediate connectivity to a central security monitor specifically equipped for temporary duty on the active construction sites. Sprinkler systems can be activated far in advance of conventional construction methods, reducing the risk of damage by fire.

Figure 5:
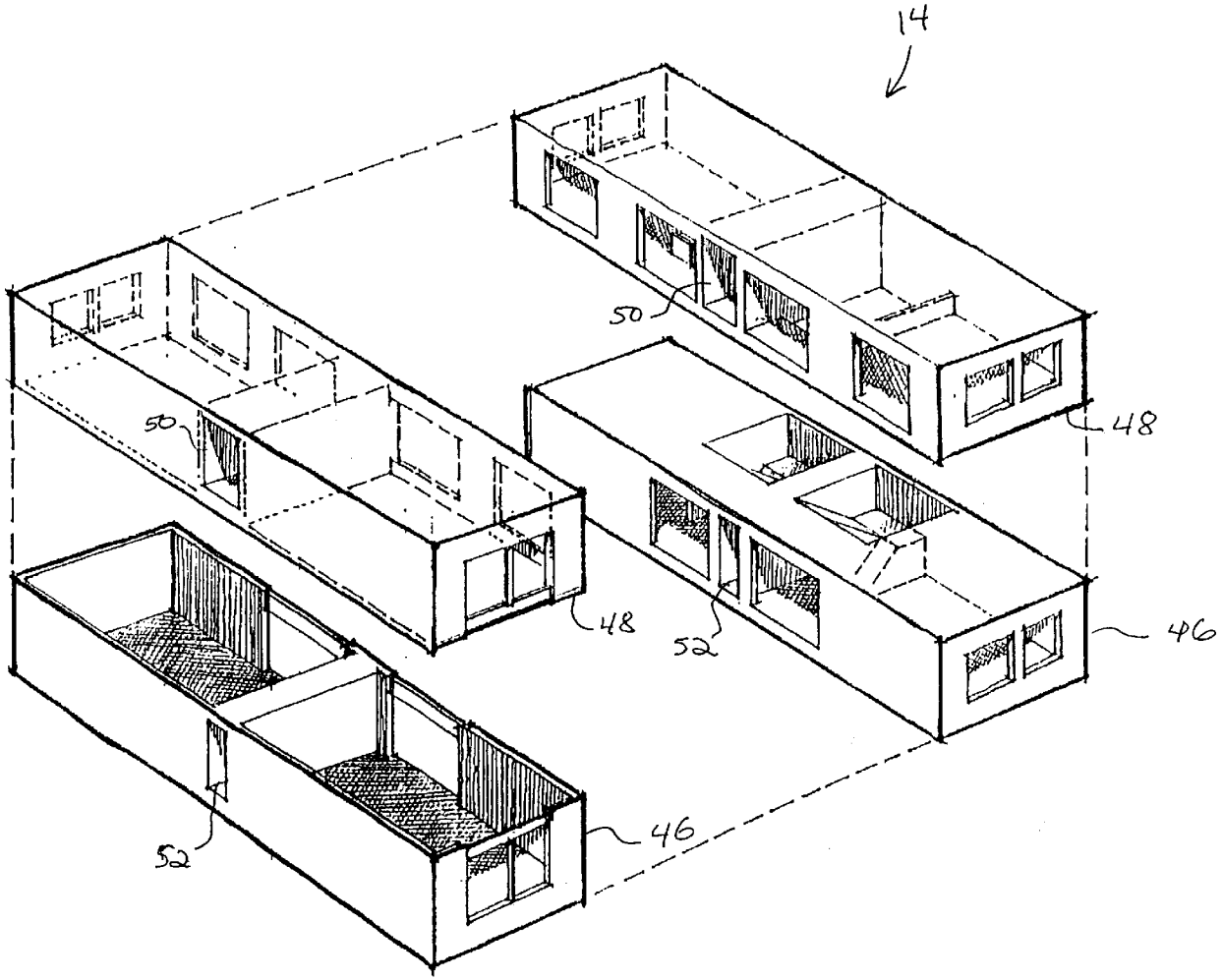
FIG. 5 is an exploded view of an "intermediate" apartment of the building of FIG. 1.
Figure 6:
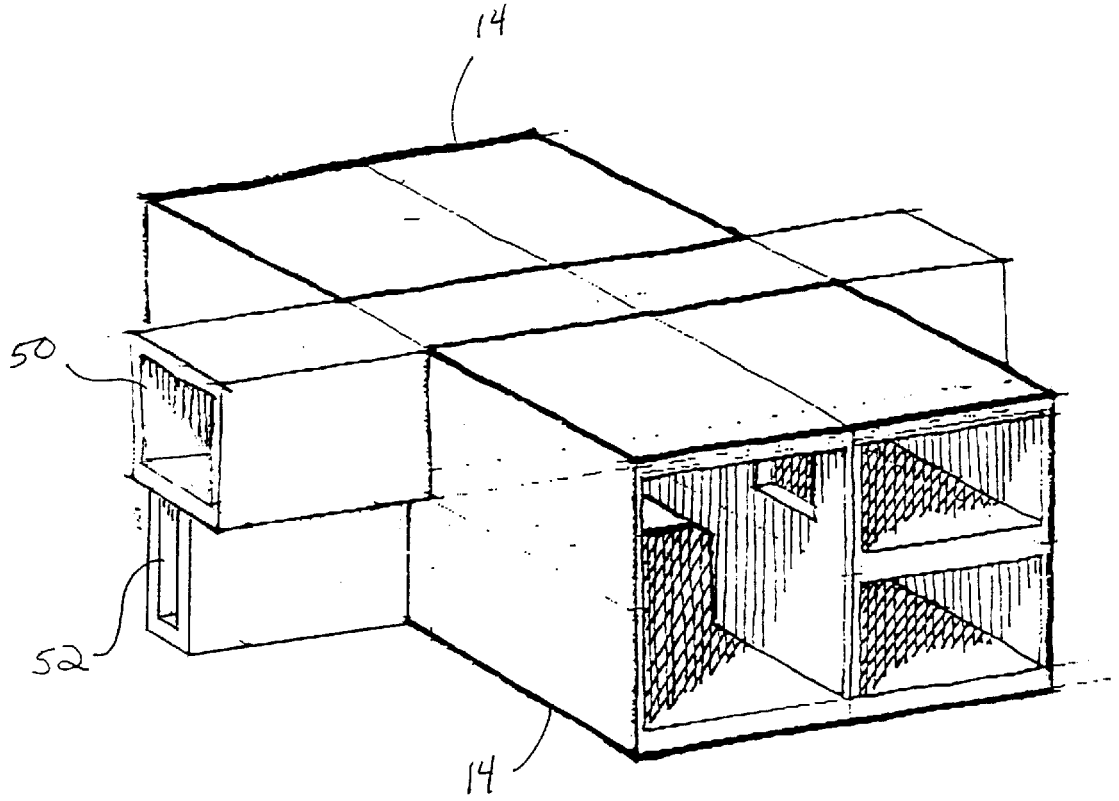
FIG. 6 is a perspective view of two units as shown in FIG. 5, illustrating corridor access and utility chase connections.

A second type of unit 14 is illustrated in FIG. 5. The modules 46 and 48 making up the unit 14 are of approximately the same size and shape as modules 20 and 22, but they combine to form different apartment shapes. The apartments does not stretch across the full width of the building 10 as does unit 12; instead, each apartment is approximately one-half the length and twice the width of unit 12, and separate apartments are placed on opposite sides of the corridor 50. The units on either side of the corridor need not be identical in space or layout, if it is desired to have a building with a variety of apartment configurations. In order to provide utility feeds for apartments on either side of the corridor 50 in this configuration, it is preferable to place the horizontal utility chase 52 under (as shown) or over the corridor 50. Access panels may be placed in the floor (or ceiling) corridor 50 if desired, but it will generally be found preferable to access the utility chase 52 from inside the apartment units in this configuration. FIG. 6 is a perspective view of two assembled units 14, with corridor 50 and utility chase 52 connections extended for clarity.

Figure 7A:
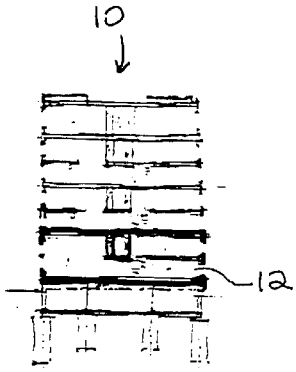
FIGS. 7*a*–7*f* are perspective and cutaway views of each unit as placed in an assembled building.
Figure 7B:
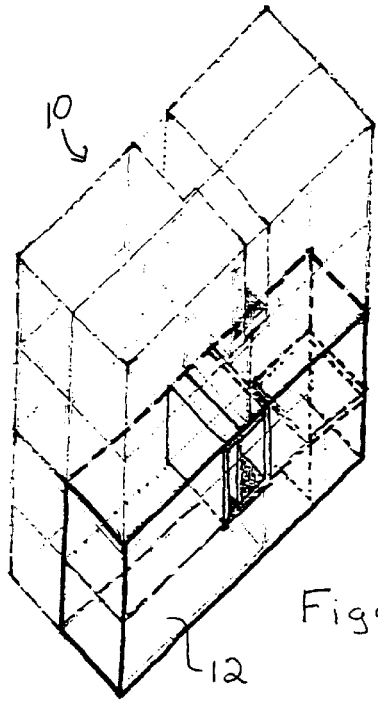
Figure 7C:
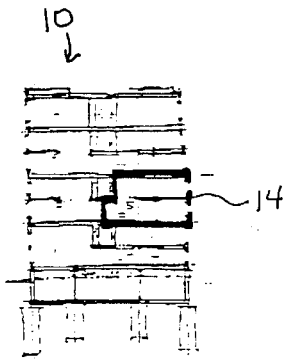
Figure 7D:
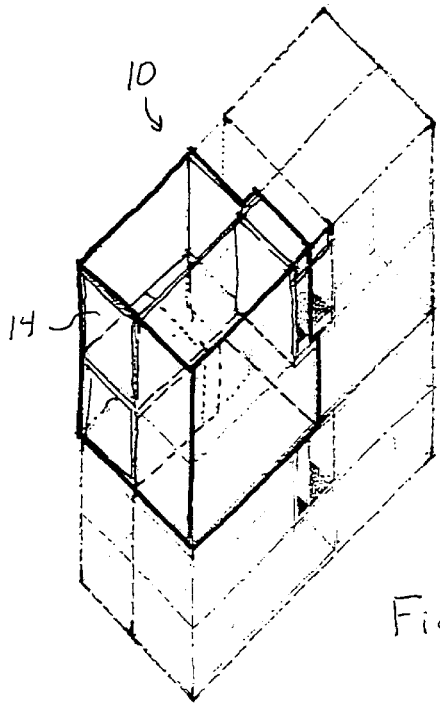
Figure 7E:
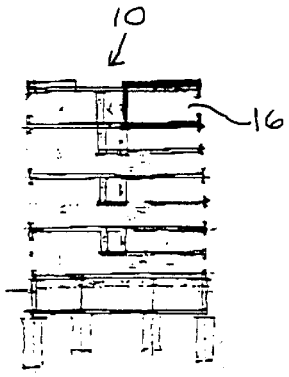
Figure 7F:
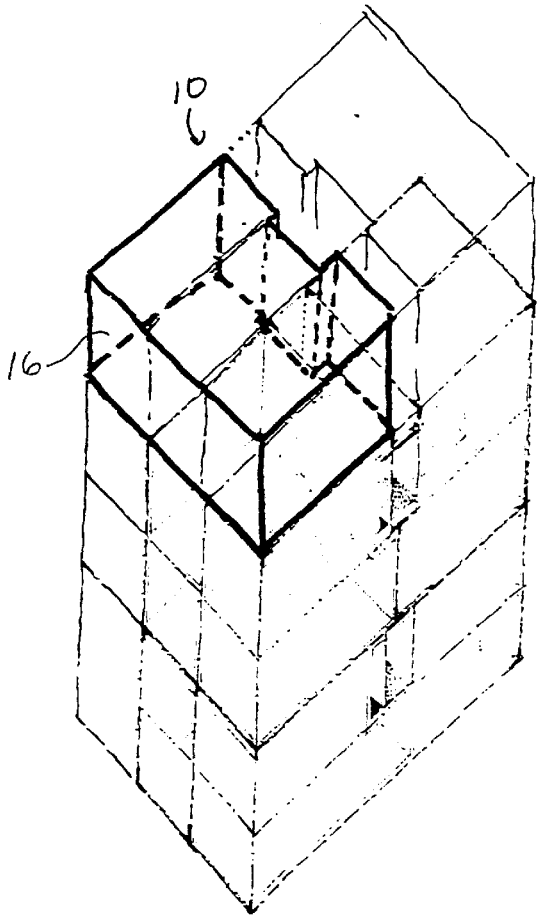

A third type of unit 16 for placement on the top level of the building 10 is shown in FIGS. 7*e* and 7*f*. As pictured, this unit comprises three modules and is three times the width of unit 12. It will be apparent to those skilled in the art that other unit shapes and sizes may also be used. As shown, unit 12 is a single-level unit (which may be made handicap-accessible if desired), but the top unit may also have a mezzanine if preferred. The modules making up this unit preferably comprise integral membrane roofing and roof drains, and may further comprise skylights, coffered ceilings, clerestories or the like to enhance the perception of light and space in the units. Unit 16 comprises horizontal chases, as do the other units 12 and 14, for rapid connection of adjacent units.

Buildings according to the invention are extremely economical in space usage. For example, in a preferred embodiment, the height X of units 12 and 14 may be 18 feet. The height Y of units 16 may be 10.5 feet, and the elevation of ground floor units 12 above the grade Z may be 5.5 feet, for a total building height of 70 feet. This configuration falls within the Building Officials and Code Administrators (BOCA) International standard for Type 3A construction of a multi-family, fully sprinklered building. (Because mezzanine areas are limited to ⅓ the area below them under the BOCA definitions, the pictured unit is considered a four-story building, and falls within the five story limit for a building of this type. Because the standard allows a five story building of this height, it may be desirable for the upper levels in one floor of apartments to be expanded, offering greater flexibility in apartment design).

Figure 8:
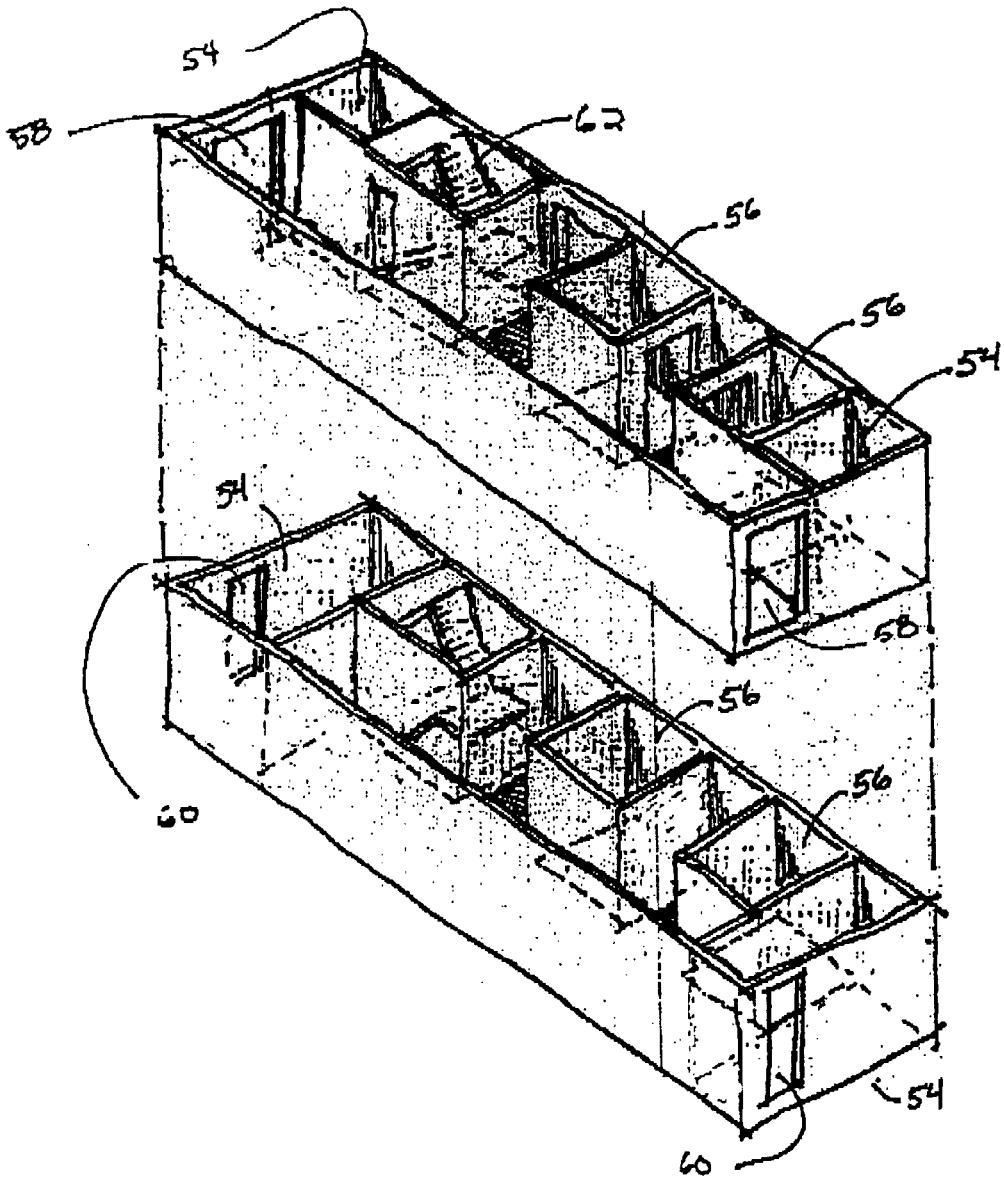
FIG. 8 shows a lobby unit for use with the units pictured in FIG. 5.

At least one vertical chase 54 is provided for the building in order to connect the daisy-chained horizontal chases of each level of the building to a central utility feed. This vertical chase may run parallel to an elevator shaft 56, for example, in order to provide further space savings. FIG. 8 shows a modular unit for a lobby area, from which two rows of units 14 may extend. (While the pictured unit is configured for connection with unit type 14, it will be apparent to those skilled in the art that lobby units for connections to unit types 12 and 16 can easily be constructed). Apertures 58 are provided for connection with the corridor 50, and apertures 60 are provided for connection with the horizontal chase 52. The lobby further comprises emergency stairs 62.

The length of base units 12 is preferably somewhat longer than that of the upper modules. This additional length ensures an interior width inside the foundation walls suitable for ease of parking and maneuvering, and serves as a basis for articulating the architectural base of a building constructed according to the invention. The extra length further serves continuous, uninterrupted bearing walls for the units above.

All units 12, 14, 16 are preferably constructed with "hard-shell integrity," allowing improved fire safety and sound deadening (high STC for residential construction). The integral roof construction of the top units 16 means that any roof failure is localized and the possibility of collateral or residual damage is minimized.

The buildings of the invention can be constructed extremely rapidly. An exemplary 96-unit building in the configuration shown in FIG. 1, for example, may be constructed in a period of about 16 weeks. Preferably, construction begins with laying of the building foundation and construction of the semidepressed parking structure, if included. A column of level lobbies, containing the elevator shaft and vertical utility feed is then constructed, and building units can then be placed in one or more wings extending from the lobby area. It will generally be found preferable to add modules to the building in stacks, placing all levels over a given base unit 12 before placing the next base unit, but construction may also proceed by placing all ground level units, followed by all second level units, etc.

It will generally be preferable for modules to be finished as much as possible in the factory, before shipping to the building site. This is facilitated by the horizontal chase structure which allows utility feeds to be placed in the chase during manufacturing, so that only splices between units need be completed in the field. The attachment of the lower module 20 to the upper module 22 must be accomplished in the field, but much of the initial machining (e.g., drilling holes, providing quick-connect fittings for ductwork and plumbing) may be accomplished at the factory, and all necessary hardware may be placed in one of the modules during the manufacturing process, allowing quick and easy connection of the modules. Carpeting, windows, etc. may all be preinstalled at the factory, allowing improved working conditions for installation personnel and lower costs for the manufacturer.

Other embodiments of the invention will be apparent to those skilled in the art from a consideration of the specification or practice of the invention disclosed herein. It is intended that the specification be considered as exemplary only, with the true scope and spirit of the invention being indicated by the following claims.

What is claimed is:

1. A multiunit building, comprising:

multiple connected units, each unit being formed by two prefabricated modules, a first module comprising a floor and four wall sections, and a second module comprising a ceiling and four wall sections, wherein the second module is stacked vertically atop the first module and connected thereto, and wherein a room of the unit so formed extends from the floor section of the first module to the ceiling section of the second module.

2. The building of claim 1, wherein at least two units are stacked one atop another.

3. The building of claim 1, wherein at least two units are placed horizontally adjacent to one another.

4. The building of claim 1, further comprising multiple lobby units connected to the multiple connected units.

5. The building of claim 4, wherein the multiple lobby units are vertically stacked and connected by at least one staircase.

6. The building of claim 1, wherein the unit comprises a room substantially contained within the second module.

7. The building of claim 1, Wherein the modules are sized to be transported on a flatbed truck.

8. A method of builing construction, comprising:

constructing a foundation;

placing a first module comprising a floor and four wall sections above the foundation;

placing a second module comprising a ceiling and four wall sections atop the first module; and securing the second module to the first module to form a building unit, wherein a room of the unit so formed extends from the floor section of the first module to the ceiling section of the second module.

9. The method of claim 8, further comprising vertically stacking multiple building units, each unit so steed comprising a first module having a floor and four wall sections and a second module having a ceiling and four wall sections.

10. The method of claim 8, further comprising connecting a second unit horizontally adjacent to the first unit, the second unit comprising a first module having a floor and four wall sections and a second module having a ceiling and four wall sections.

11. The method of claim 10, wherein the first unit and the second unit each comprise a horizonal chase containing at least one utility feed, and further comprising connecting the utility feed of the first unit to the utility feed of the second unit.

12. The method of claim 8, wherein the first module and the second module are constructed in a remote-location and transported to the site of the foundation for placement thereon.

13. A multiunit modular building, comprising:

multiple connected units, each unit comprising a module having a corridor section and a module comprising a horizontal utility chase section, whereby the corridor sections connect to form an access corridor and the utility chase sections connect to form a horizonal utility chase containing a utility feed.

14. The building of claim 13, wherein at least two units are stacked one atop another.

15. The building of claim 13, wherein at least two units are placed horizontally adjacent to one another.

16. The builing of claim 13, further comprising multiple lobby units connected to the multiple connected units.

17. The building of claim 16, wherein the multiple lobby units are vertically stacked and connected by at least one staircase.

18. The building of claim 17, wherein the vertically stacked lobby units are connected by at least one vertical chase containing a utility feed.

19. The building of claim 13, wherein the utility feed is selected from the group consisting of water pipes, electrical wiring, communications and security systems, and life safety systems.

20. The building of claim 13, wherein the modules are sized to be transported on a flatbed truck.

21. The building of claim 13, wherein the corridor section and the horizontal utility chase section are both contained within the same module.

22. A method of constructing a modular building, comprising:

installing a first unit comprising a first corridor section and a first horizontal utility chase section, wherein the first utility chase section contains a utility feed;

installing a second unit comprising a second corridor section and a second horizontal utility chase section containing a utility feed;

connecting the units so that the first corridor section and the second corridor section combine to form an access corridor, and the first utility chase and the second utility chase combine to form a contiuous utility chase; and connecting the utility feed of the first unit and the utility feed of the second unit for supply of utility services to the units.

23. The method of claim 22, wherein the utility feeds are selected from the group consisting of water pipes, electrical wiring, communication and security systems, and life safety systems

24. The method of claim 22, wherein each unit comprises two vertically stacked modules.

25. The method of claim 22, wherein the first unit and the second unit are constructed in a remote location and transported to the site of the building.

26. The method of claim 22, further comprising installing a first lobby unit comprising a utility chase section containing a utility feed and connecting the lobby utility feed to the utility feed of the first unit.

27. The method of claim 26, further comprising installing a second lobby unit comprising a utility chase section containing a utility feed atop the first lobby unit and connecting the utility feeds of the first and second lobby units via a vertical utility chase.

* * * * *